United States Patent [19]

Platzer et al.

[11] 4,413,782

[45] Nov. 8, 1983

[54] JET EXCITATION BY AN OSCILLATING VANE

[75] Inventors: Maximilian F. Platzer, Pebble Beach, Calif.; John M. Simmons, Indooroopilly, Australia

[73] Assignee: The United States of America as represented by the Secretary of the Navy, Washington, D.C.

[21] Appl. No.: 217,871

[22] Filed: Dec. 18, 1980

[51] Int. Cl.[3] ..... B05B 3/14

[52] U.S. Cl. ..... 239/102; 239/265.19; 239/380

[58] Field of Search ..... 239/102, 265.19, 380, 239/485; 366/119, 108; 417/151, 182, 194

[56] References Cited

U.S. PATENT DOCUMENTS

| | | | |
|---|---|---|---|
| 2,619,767 | 12/1952 | Woock | 239/380 X |
| 2,664,700 | 1/1954 | Benoit | 239/265.19 X |
| 2,770,501 | 11/1956 | Coanda | 239/102 |
| 2,932,494 | 4/1960 | Wales | 366/108 |
| 3,614,069 | 10/1971 | Murry | 366/119 |
| 3,895,759 | 7/1975 | DePalma | 239/498 |
| 3,970,253 | 7/1976 | Burkes et al. | 239/265.19 |
| 3,998,386 | 12/1976 | Viets et al. | 239/102 |
| 4,052,002 | 10/1977 | Stouffer | 239/102 |

*Primary Examiner*—John J. Love
*Assistant Examiner*—Gene A. Church
*Attorney, Agent, or Firm*—R. F. Beers; Charles D. B. Curry; George L. Craig

[57] ABSTRACT

To achieve rapid mixing between a jet flow and its surrounding medium a vane is mounted in the jet downstream of the jet nozzle exit. The vane is oscillated in either pitch or plunge by an appropriate excitation mechanism at a constant frequency. The amplitude of oscillation is typically only a few degrees. The oscillation frequency may be varied to control the entrainment rate.

6 Claims, 4 Drawing Figures

JET EXCITATION BY AN OSCILLATING VANE

BACKGROUND OF THE INVENTION

1. Field of the Invention

The present invention relates to jet mixing and entrainment, and more particularly to enhancing jet mixing and entrainment by means of an oscillating vane in the jet nozzle exit.

2. Description of the Prior Art

For a number of applications it is desirable to achieve rapid mixing between a jet flow and its surrounding medium which may be either stationary or coflowing at a different velocity. Such applications occur in certain types of ejectors, particularly ejectors for vertical take-off and landing (VTOL) aircraft, but also in a number of other fields. A number of methods have been suggested in the past to enhance this jet mixing and secondary flow entrainment. The most notable ones are hypermixing, as used in the thrust augmentation ejectors of the Navy-Rockwell VTOL aircraft, acoustic excitation, pulsing and excitation by a freely vibrating little airfoil. Only the hypermixing nozzle appears to have been developed to the point of practical application. It is desired to further enhance the jet mixing and secondary flow entrainment over these prior methods.

SUMMARY OF THE INVENTION

Accordingly, the present invention provides a means for enhancing jet mixing and entrainment by mounting an oscillating vane close to the jet exit. The vane is oscillated in either pitch or plunge by a suitable excitation mechanism at a constant frequency which can be arbitrarily set to control the entrainment rate. The amplitude of oscillation is typically only a few degrees, thus requiring little power without degradation of the jet nozzle efficiency.

Therefore it is an object of the present invention to achieve rapid mixing between a jet flow and its surrounding medium and rapid entrainment of the surrounding medium into the jet without degradation of the jet nozzle efficiency.

Other objects, advantages and novel features of the present invention will be apparent from the following detailed description in conjunction with the appended claims and attached drawing.

DESCRIPTION OF THE PREFERRED EMBODIMENT

Figure 1:
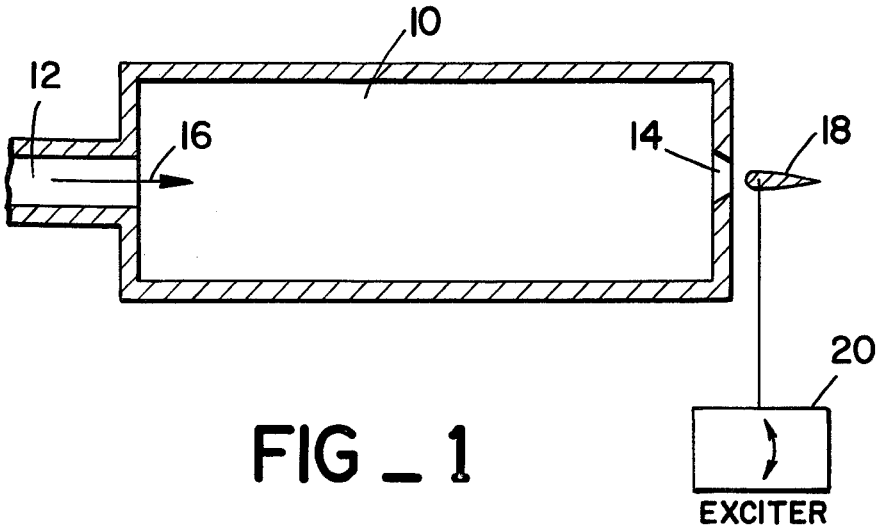
FIG. 1 is a cross-sectional schematic representation of a means for enhancing jet mixing and secondary flow entrainment.
Figure 2:
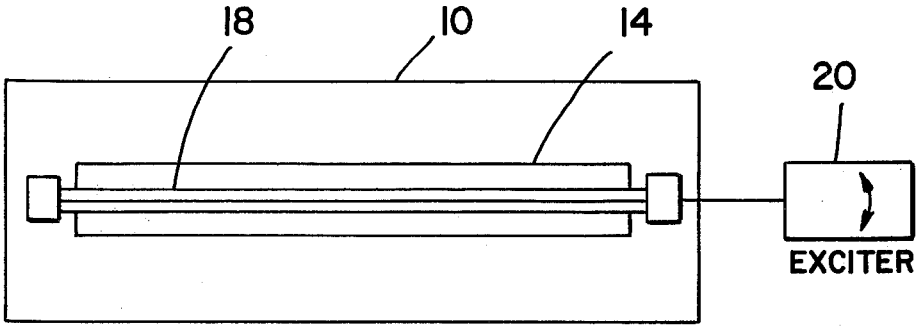
FIG. 2 is a plan view of the end of the enhancing means of FIG. 1.

Referring now to FIGS. 1 and 2 a plenum chamber 10 is shown, having an inlet port 12 and an exit nozzle (essentially two-dimensional) 14. A turbulent jet flow 16, indicated by the heavy arrow, flows through the plenum chamber 10 from the inlet port 12 and exits via the nozzle 14. A vane 18 having winglike shape in cross-section and spanning the entire nozzle 34 is located symmetrically with respect to the nozzle 14 in or close to the potential core of the jet flow 16 just downstream from the nozzle. The vane 18 is oriented such that its leading edge first intercepts the jet flow 16 to be entrained. A means 20 for oscillating the vane 18 is provided so that the vane pivots about an axis through its span in pitch. The oscillating means 20, or exciter, allows the vane 18 to be oscillated at various frequencies and amplitudes about a mean position set at zero angle of attack relative to the jet flow 16. Excitation of the jet flow 16 by the oscillating vane 18 produces a widening of the jet flow which significantly exceeds the spreading angle due to the small amplitude oscillation with only a negligible upstream influence. The oscillating means 20 may be any suitable mechanical, electromagnetic or the like device such as is well known in the art. The vane may also be excited by the jet itself, i.e., by fluid mechanical or fluidic means.

Figure 3:
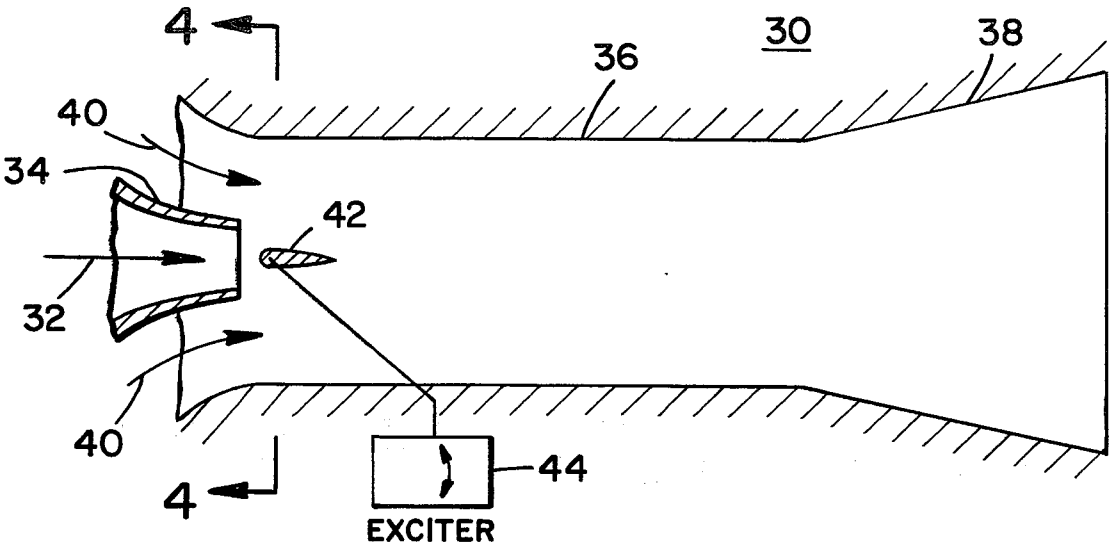
FIG. 3 is a cross-sectional view of an ejector according to the present invention.
Figure 4:
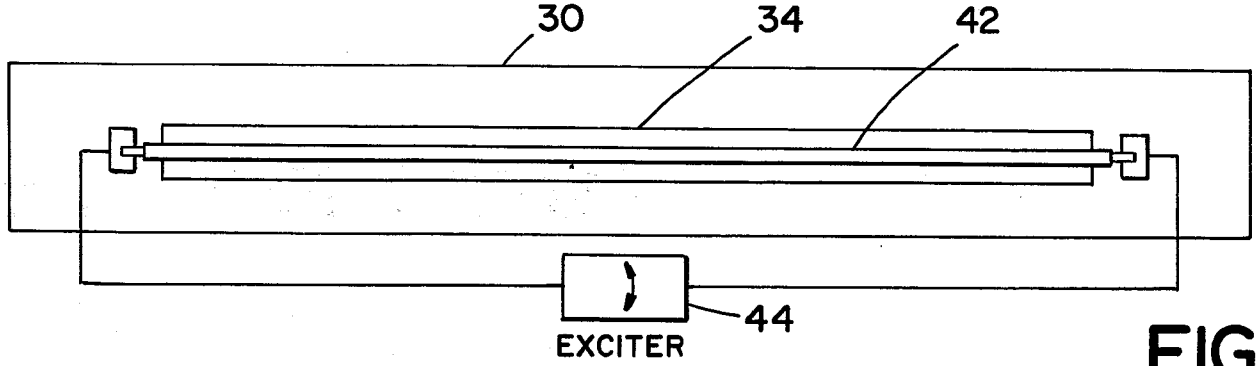
FIG. 4 is a cross-sectional view of the ejector of FIG. 3 taken along line IV—IV.

FIGS. 3 and 4 show an ejector 30 such as is used in a VTOL aircraft. A primary jet flow 32, indicated by the dark arrow, from an engine or plenum chamber enters the ejector 30 through a nozzle 34. The ejector 30 has a mixing duct 36 followed by a diffuser 38. The primary jet flow 32 is mixed with a secondary flow 40, indicated by the light arrows, in the mixing duct 36. A vane 42 is situated in or close to the potential core of the primary jet flow 32 just downstream from the nozzle 34. A means 44 for oscillating, or an exciter, is connected to the vane 42 to provide a small amplitude pitch oscillation about a zero angle of attack relative to the primary jet flow 32. The vane 42 as in the embodiment shown in FIG. 1 spans the entire nozzle 34 width. Since the jet mixing/entrainment increases with increasing vane frequency and amplitude, the vane 42 can be driven at an arbitrarily controlled frequency and amplitude to provide a versatile mechanism for mixing/entrainment control. Typical amplitudes of oscillation are up to $\pm 5$ degrees at frequencies of 5 to 50 Hz.

Thus, the present invention provides a means for enhancing jet mixing and entrainment by the oscillating vane in or close to the potential core of the primary jet flow just downstream from the nozzle exit without affecting upstream characteristics, i.e., nozzle efficiency. The amplitude and frequency of the oscillating vane can be arbitrarily set to achieve optimum effect with little power expenditure.

What is claimed is:

1. A device for enhancing mixing and entrainment of the central jet exhaust from a chamber with a medium surrounding said chamber comprising:

(a) a nozzle through which a turbulent jet stream flows;

(b) a vane having a leading and a trailing edge and situated just downstream from said nozzle in or near the core of said jet stream, said vane having winglike shape and spanning said nozzle, said vane having said leading edge blunter than said trailing edge; and (c) means connected to said vane for causing said vane to oscillate about an axis through its span in pitch at a selectively variable amplitude and frequency about a zero angle of attack relative to said jet stream.

2. An improved ejector for enhancing entrainment of a central jet stream exhaust from a chamber with a medium surrounding said chamber of the type having a mixing duct with a primary nozzle inlet and a secondary nozzle inlet wherein the improvement comprises:

(a) a vane having a leading edge and a trailing edge downstream from but close to said primary nozzle exit in said mixing duct, said vane having winglike shape and spanning said mixing duct, said vane having said leading edge blunter than said trailing edge and intercepting said central jet stream at or near the core of said jet stream; and (b) means connected to said vane for causing said vane to oscillate about an axis through its span in pitch at a selectively variable amplitude and frequency about a zero angle of attack relative to said jet stream.

3. The device for enhancing jet mixing and entrainment as recited in claim 1 wherein the range of said amplitude of oscillation is ±5°.

4. The device for enhancing jet mixing and entrainment as recited in claim 1 wherein said frequency of oscillation extends from 5 Hz to 50 Hz.

5. The improved ejector of claim 2 wherein the range of said amplitude of oscillation is ±5°.

6. The improved ejector of claim 2 wherein said frequency of oscillation extends from 5 Hz to 50 Hz.

* * * * *